US007396623B2

(12) United States Patent
Wu et al.

(10) Patent No.: US 7,396,623 B2
(45) Date of Patent: Jul. 8, 2008

(54) PHOTORECEPTOR LAYER HAVING VINYLIDENE FLUORIDE

(75) Inventors: Jin Wu, Webster, NY (US); Liang-bin Lin, Rochester, NY (US); Linda L. Ferrarese, Rochester, NY (US); John J. Wilbert, Macedon, NY (US); James R. Backus, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 413 days.

(21) Appl. No.: 11/223,517

(22) Filed: Sep. 9, 2005

(65) Prior Publication Data

US 2007/0059621 A1 Mar. 15, 2007

(51) Int. Cl.
*G03G 5/14* (2006.01)

(52) U.S. Cl. ..... 430/60; 430/131

(58) Field of Classification Search ..... 430/60, 430/65, 131

See application file for complete search history.

(56) References Cited

U.S. PATENT DOCUMENTS

| | | | | |
|---|---|---|---|---|
| 4,654,284 | A | 3/1987 | Yu et al. | |
| 5,244,762 | A * | 9/1993 | Spiewak et al. | 430/64 |
| 5,725,985 | A | 3/1998 | Nealey et al. | |
| 5,958,638 | A | 9/1999 | Katayama et al. | |
| 6,015,645 | A | 1/2000 | Murti et al. | |
| 6,017,666 | A | 1/2000 | Nealey et al. | |
| 6,132,912 | A | 10/2000 | Fuller et al. | |
| 6,824,940 | B2 | 11/2004 | Wu et al. | |
| 2006/0110671 | A1 * | 5/2006 | Lin et al. | 430/65 |
| 2006/0121377 | A1 * | 6/2006 | Herbert et al. | 430/64 |

* cited by examiner

*Primary Examiner*—John L Goodrow
(74) *Attorney, Agent, or Firm*—Pillsbury Winthrop Shaw Pittman LLP

(57) ABSTRACT

The presently disclosed embodiments relate in general to electrophotographic imaging members, such as layered photoreceptor structures, and processes for making and using the same. More particularly, the embodiments pertain to a photoreceptor that incorporates a material with a high dielectric constant that improves background and print image quality.

17 Claims, 3 Drawing Sheets

PHOTORECEPTOR LAYER HAVING VINYLIDENE FLUORIDE

BACKGROUND

In xerography, or electrophotographic printing/copying, an electrophotographic imaging member is electrostatically charged. For optimal image production, the electrophotographic imaging member should be uniformly charged across its entire surface. The electrophotographic imaging member is then exposed to a light pattern of an input image to selectively discharge the surface of the electrophotographic imaging member in accordance with the image. The resulting pattern of charged and discharged areas on the electrophotographic imaging member forms an electrostatic charge pattern (i.e., a latent image) conforming to the input image. The latent image is developed by contacting it with finely divided electrostatically attractable powder called toner. Toner is held on the image areas by electrostatic force. The toner image may then be transferred to a substrate or support member, and the image is then affixed to the substrate or support member by a fusing process to form a permanent image on the substrate or support member. After transfer, excess toner left on the electrophotographic imaging member is cleaned from its surface, and residual charge is erased from the electrophotographic imaging member.

Electrophotographic imaging members can be provided in a number of forms. For example, an electrophotographic imaging member can be a homogeneous layer of a single material, such as vitreous selenium, or it can be a composite layer containing an electrophotographic layer and another material. In addition, the electrophotographic imaging member can be layered.

Conventional layered electrophotographic imaging members generally have at least a flexible substrate support layer and two active layers. These active layers generally include a charge generation layer containing a light absorbing material, and a charge transfer layer containing charge transport molecules. These layers can be in any order, and sometimes can be combined in a single or a mixed layer. The flexible substrate support layer can be formed of a conductive material. Alternatively, a conductive layer can be formed on top of a nonconductive flexible substrate support layer.

Conventional electrophotographic imaging members may be either a function-separation type photoreceptor, in which a layer containing a charge generation substance (charge generation layer) and a layer containing a charge transport substance (charge transfer layer) are separately provided, or a monolayer type photoreceptor in which both the charge generation layer and the charge transfer layer are contained in the same layer.

Conventional binders used in electrophotographic imaging members typically contain vinyl chloride. Examples of conventional binders are disclosed in U.S. Pat. No. 5,725,985, incorporated herein by reference in its entirety, and U.S. Pat. No. 6,017,666, incorporated herein by reference in its entirety. Additionally, electrophotographic imaging members may be non-halogenated polymeric binders, such as a non-halogenated copolymers of vinyl acetate and vinyl acid.

Conventional electrophotographic imaging members may have an undercoat layer (UCL) interposed between the conductive support and the charge generation layer. Examples of conventional UCLs are disclosed in U.S. Pat. Nos. 5,958,638, and 6,132,912, incorporated herein by reference in their entireties.

Conventional electrophotographic imaging members may also have an interface layer (IFL) interposed between the UCL and the charge generation layer. Examples of conventional IFLs are disclosed in U.S. Pat. Nos. 6,824,940 B2 and 6,015,645, incorporated herein by reference in their entireties.

SUMMARY

According to embodiments illustrated herein, there is a need for polymers that can improve print quality. The disclosure describes vinylidene fluoride polymer or its copolymer to improve the electrical properties and performance of electrophotographic imaging members. The presence of vinylidene fluoride polymeric resin in one or both of a UCL and an IFL can play an important role in preventing image quality defects.

In particular, an embodiment provides an electrophotographic imaging member, comprising a substrate, an undercoat layer formed on the substrate, at least one imaging layer formed on the undercoat layer, and optionally an interface layer formed between the undercoat layer and the at least one imaging layer, wherein at least one of the undercoat layer and the interface layer comprises a polymer having a high dielectric constant.

In other embodiments, there is provided a process for preparing an electrophotographic imaging member, comprising forming an undercoat layer on an electrophotographic imaging member, forming at least one imaging layer on the undercoat layer, and optionally forming an interface layer formed between the undercoat layer and the at least one imaging layer, wherein at least one of the undercoat layer and the interface layer comprises a polymer having a high dielectric constant.

BRIEF DESCRIPTION OF THE DRAWINGS

Reference may be had to the accompanying figures.

DETAILED DESCRIPTION

In the following description, reference is made to the accompanying drawings, which form a part hereof and which illustrate several embodiments.

Embodiments relate to a photoreceptor having a material of high dielectric constant incorporated into the photoreceptor components to help reduce, and preferably substantially eliminate, specific printing defects in the print images. The embodiments include incorporating a polymer with high dielectric constant, typically at least 5 or greater at 20° C. and 1 kHz, into an undercoat layer formulation and/or an interface layer formulation.

According to embodiments, an electrophotographic imaging member is provided that includes a polymer with a high dielectric constant, typically at least 5 or greater at 20° C. and 1 kHz, into an undercoat layer and/or interface layer to improve background and print characteristics. In other embodiments, the dielectric constant is between 7 and 25, or between 8 and 18, at 20° C. and 1 kHz. In some embodiments, vinylidene fluoride polymeric resin is used as the high dielectric constant polymer. The molecular weight of the vinylidene fluoride polymers is from about 5,000 to about 5,000,000.

Vinylidene fluoride polymeric resins may be obtained by polymerization of vinylidene fluoride or by copolymerization of vinylidene fluoride and at least one other fluorine-containing monomer. Examples of other fluorine-containing monomer are tetrafluoroethylene, trifluoroethylene, trifluorochloroethylene, trifluorobromoethylene, hexafluoropropylene, difluorochloroethylene, difluorobromoethylene, fluorochloroethylene, and the like, and the mixtures thereof. Examples of these polymers may have one or more of the following structures:

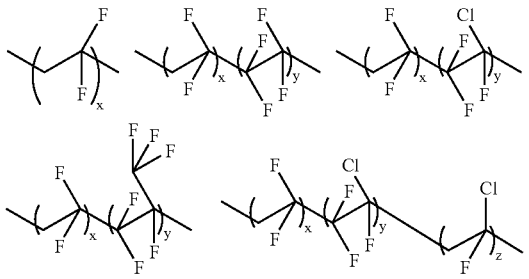

wherein x is from about 10 to about 100 mole percent, y is from about 0 to about 90 mole percent, z if from about 0 to about 90 mole percent, and x+y+z=100. In embodiments, an electrophotographic imaging member binder may include one or more vinylidene fluoride polymers. In various embodiments, an electrophotographic imaging member binder may include a series of vinylidene fluoride polymers. In various embodiments, an electrophotographic imaging member binder may include only one or more vinylidene fluoride polymers. In various embodiments, an electrophotographic imaging member binder may include one or more vinylidene fluoride polymers along with other binders, colorants, additives, and various other components.

Electrophotographic Imaging Member

Figure 1:
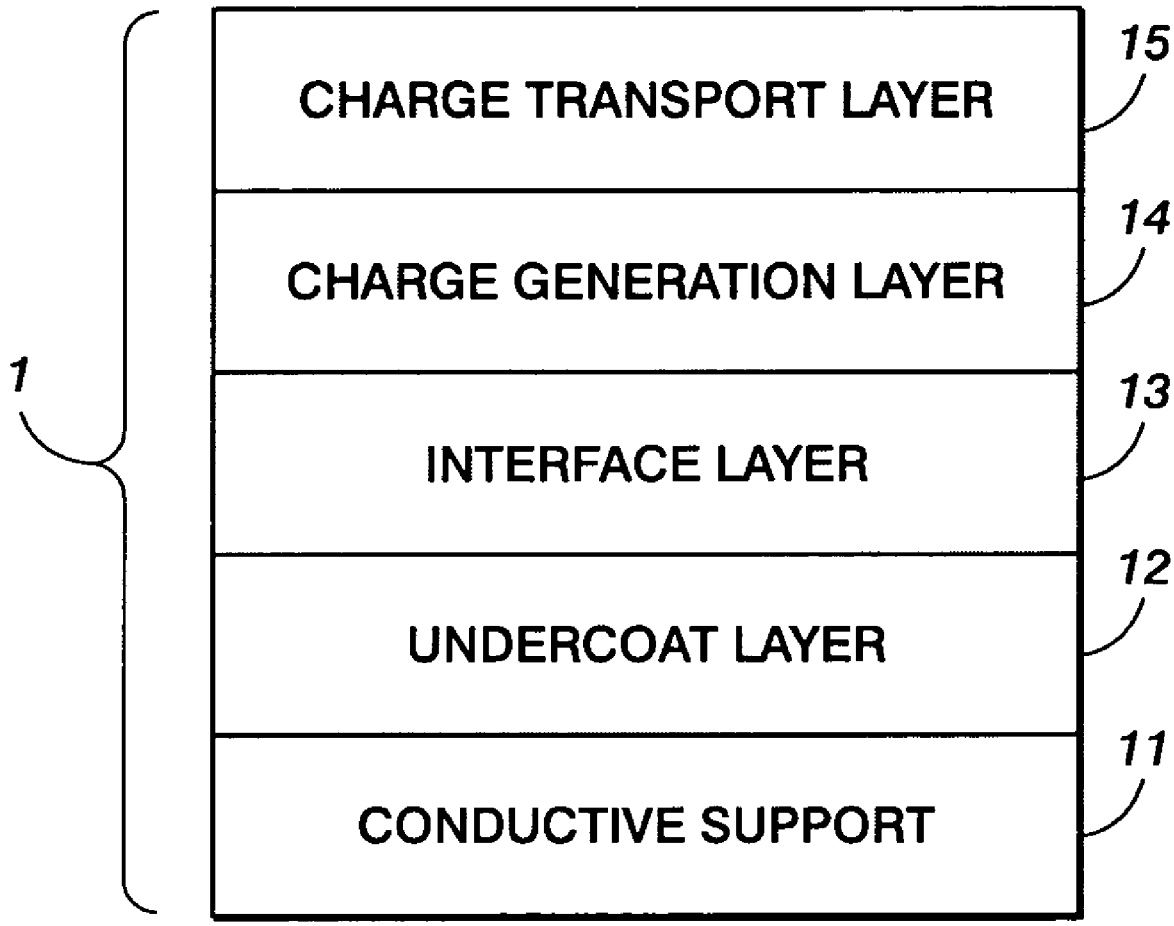
FIG. 1 is a block diagram outlining the elements of an electrophotographic imaging member.

FIG. 1 is a cross sectional view schematically showing an embodiment of an electrophotographic imaging member. The electrophotographic imaging member 1 shown in FIG. 1 contains separate charge generation layer 14 and charge transfer layer 15. In the embodiment illustrated in FIG. 1, a UCL 12 and an optional IFL 13 are included in the electrophotographic imaging member 1. In embodiments, the UCL 12 is interposed between the charge generation layer 14 and the conductive support 11. In embodiments, the IFL is interposed between the UCL 12 and the charge generation layer 14. In embodiments, the UCL is located between the conductive support and the charge generation layer, without any intervening layers. In various embodiments, additional layers, such as an IFL or an adhesive layer, may be present and located between the UCL and the charge generation layer, and/or between the conductive support and the UCL.

In embodiments, the conductive support 11 may include, for example, a metal plate, a metal drum or a metal belt using a metal such as aluminum, copper, zinc, stainless steel, chromium, nickel, molybdenum, vanadium, indium, gold or a platinum, or an alloy thereof; and paper or a plastic film or belt coated, deposited or laminated with a conductive polymer, a conductive compound such as indium oxide, a metal such as aluminum, palladium or gold, or an alloy thereof. Further, surface treatment such as anodic oxidation coating, hot water oxidation, chemical treatment, coloring or diffused reflection treatment such as graining can also be applied to a surface of the support 11.

In embodiments, undercoat binders used in the UCL 12 may contain one or more vinylidene fluoride polymers in addition to one or more conventional binder resins. Examples of conventional binder resins include, but are not limited to, polyamides, vinyl chlorides, vinyl acetates, phenols, polyurethanes, melamines, benzoguanamines, polyimides, polyethylenes, polypropylenes, polycarbonates, polystyrenes, acrylics, methacrylics, vinylidene chlorides, polyvinyl acetals, epoxys, silicones, vinyl chloride-vinyl acetate copolymers, polyvinyl alcohols, polyesters, polyvinyl butyrals, nitrocelluloses, ethyl celluloses, caseins, gelatins, polyglutamic acids, starches, starch acetates, amino starches, polyacrylic acids, polyacrylamides, zirconium chelate compounds, titanyl chelate compounds, titanyl alkoxide compounds, organic titanyl compounds, and silane coupling agents. These can be used either alone or as a combination of two or more of them. Furthermore, in embodiments, fine particles of titanium oxide, zinc oxide, tin oxide, antimony-doped tin oxide, aluminum oxide, silicon oxide, zirconium oxide, barium titanate, or the like may be added to the undercoat binders.

In embodiments, the undercoat binders used in the UCL 12 may contain one or more conventional binder resins in the absence of vinylidene fluoride polymers, for example when the electrophotographic imaging member includes an IFL 13 containing one or more vinylidene fluoride polymers.

In embodiments, undercoat layers include various colorants. In various embodiments, undercoat layers may include organic pigments and organic dyes, including, but not limited to, azo pigments, quinoline pigments, perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes, and cyanine dyes. In various embodiments, undercoat layers may include inorganic materials, such as amorphous silicon, amorphous selenium, tellurium, a selenium-tellurium alloy, cadmium sulfide, antimony sulfide, titanium oxide, tin oxide, zinc oxide, and zinc sulfide, and mixtures thereof.

In embodiments, the UCL 12 may be formed between the electroconductive support and the charge generation layer. The UCL is effective for blocking leakage of charge from the electroconductive support to the charge generation layer and/or for improving the adhesion between the electroconductive support and the charge generation layer. In embodiments, one or more additional layers may exist between the UCL 12 and the charge generation layer.

In embodiments, the UCL 12 can be coated onto the conductive support 11 from a suitable solvent. Typical solvents include, for example, N,N-dimethyl formamide, N,N-dimethyl acetamide, dimethyl sulfoxide, tetrahydrofuran, dichloromethane, xylene, toluene, methanol, ethanol, 1-butanol, methyl ethyl ketone, methyl isobutyl ketone, and mixtures thereof.

In embodiments, the UCL 12 may be coated onto the conductive substrate 11 using various coating methods. Suitable coating methods include, but are not limited to, blade coating, wire bar coating, spray coating, dip coating, bead coating, air knife coating or curtain coating is employed. In embodiments, the thickness of the UCL is from about 0.001 μm to about 30 μm.

In embodiments, the thickness of the UCL is from about 0.01 μm to about 5 μm. In various embodiments, the thickness of the UCL is about 0.1 μm to about 1 μm.

In embodiments, the electrophotographic imaging member 1 may optionally include an IFL 13. In various embodiments, the IFL 13 may contain one or more vinylidene fluoride polymers. In various embodiments, the IFL 13 contains only one or more vinylidene fluoride polymers.

In embodiments, the IFL 13 may contain one or more vinylidene fluoride polymers and one or more conventional components. Examples of conventional components include, but are not limited to, polyesters, polyamides, poly(vinyl butyral), poly(vinyl alcohol), polyurethane and polyacrylonitrile. In various embodiments, the IFL may also contain conductive and nonconductive particles, such as zinc oxide, titanium dioxide, silicon nitride, carbon black, and the like.

In embodiments, the IFL 13 may be formed between the UCL and the charge generation layer. In embodiments, one or more additional layers may exist between the IFL 13 and the charge generating layer.

In embodiments, the IFL 13 may contain one or more conventional components in the absence of vinylidene fluoride polymers, for example when the electrophotographic imaging member includes a UCL 12 containing one or more vinylidene fluoride polymers.

In embodiments, the IFL 13 may be coated onto a substrate using various coating methods. Suitable coating methods include, but are not limited to, blade coating, wire bar coating, spray coating, dip coating, bead coating, air knife coating or curtain coating is employed. In embodiments, the thickness of the IFL is from about 0.001 μm to about 5 μm. In various embodiments, the thickness of the IFL is from about 0.01 μm to about 1.0 μm. In various embodiments, the thickness of the IFL is from about 0.1 μm to about 0.5 μm.

In embodiments, the charge generation layer 14 can be formed by applying a coating solution containing the charge generation substance(s) and a binding resin, and further fine particles, an additive, and other components.

In embodiments, binding resins used in the charge generation layer 14 may include polyvinyl acetal resins, polyvinyl formal resins or a partially acetalized polyvinyl acetal resins in which butyral is partially modified with formal or acetoacetal, polyamide resins, polyester resins, modified ether-type polyester resins, polycarbonate resins, acrylic resins, polyvinyl chloride resins, polyvinylidene chlorides, polystyrene resins, polyvinyl acetate resins, vinyl chloride-vinyl acetate copolymers, silicone resins, phenol resins, phenoxy resins, melamine resins, benzoguanamine resins, urea resins, polyurethane resins, poly-N-vinylcarbazole resins, polyvinylanthracene resins and polyvinylpyrene resins. These can be used either alone or as a combination of two or more of them.

In embodiments, the solvents used in preparing the charge generation layer coating solution may include organic solvents such as methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride and chloroform, mixtures thereof, and the like.

In embodiments, the charge generation layer 14 may include various charge generation substances, including, but not limited to, various organic pigments and organic dyes such as an azo pigment, a quinoline pigment, a perylene pigment, an indigo pigment, a thioindigo pigment, a bisbenzimidazole pigment, a phthalocyanine pigment, a quinacridone pigment, a quinoline pigment, a lake pigment, an azo lake pigment, an anthraquinone pigment, an oxazine pigment, a dioxazine pigment, a triphenylmethane pigment, an azulenium dye, a squalium dye, a pyrylium dye, a triallylmethane dye, a xanthene dye, a thiazine dye and cyanine dye; and inorganic materials such as amorphous silicon, amorphous selenium, tellurium, a selenium-tellurium alloy, cadmium sulfide, antimony sulfide, zinc oxide and zinc sulfide. The charge generation substances may be used either alone or as a combination of two or more of them. In embodiments, the ratio of the charge generation substance to the binding resin is within the range of 5:1 to 1:2 by volume.

In embodiments, the charge generation layer 14 is formed by various forming methods, including but not limited to, dip coating, roll coating, spray coating, rotary atomizers, and the like. In various embodiments, the charge generation layer 14 is formed by the vacuum deposition of the charge generation substance(s), or by the application of a coating solution in which the charge generation substance is dispersed in an organic solvent containing a binding resin. In embodiments, the deposited coating may be effected by various drying methods, including, but not limited to, oven drying, infra-red radiation drying, air drying and the like.

In embodiments, a stabilizer such as an antioxidant or an inactivating agent can be added to the charge generation layer 14. The antioxidants include, for example, antioxidants such as phenolic, sulfur, phosphorus and amine compounds. The inactivating agents include bis(dithiobenzyl)nickel and nickel di-n-butylthiocarbamate. The charge transfer layer 14 may further contain an additive such as a plasticizer, a surface modifier, and an agent for preventing deterioration by light.

In embodiments, the charge transfer layer 15 can be formed by applying a coating solution containing the charge transport substance(s) and a binding resin, and further fine particles, an additive, and other components.

In embodiments, binding resins used in the charge transfer layer 15 are high molecular weight polymers that can form an electrical insulating film. Examples of these binding resins include, but are not limited to, polyvinyl acetal resins, polyamide resins, cellulose resins, phenol resins, polycarbonates, polyesters, methacrylic resins, acrylic resins, polyvinyl chlorides, polyvinylidene chlorides, polystyrenes, polyvinyl acetates, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazoles, polyvinyl butyrals, polyvinyl formals, polysulfones, caseins, gelatins, polyvinyl alcohols, phenol resins, polyamides, carboxymethyl celluloses, vinylidene chloride-based polymer latexes, and polyurethanes.

In embodiments, the charge transfer layer 15 may include various activating compounds that, as an additive dispersed in electrically inactive polymeric materials, makes these materials electrically active. These compounds may be added to polymeric materials which are incapable of supporting the injection of photogenerated holes from the charge generation material and incapable of allowing the transport of these holes there through. This will convert the electrically inactive polymeric material to a material capable of supporting the injection of photogenerated holes from the charge generation material and capable of allowing the transport of these holes through the active layer in order to discharge the surface charge on the active layer. In embodiments, the charge transfer layer 15 is from about 25 percent to about 75 percent by weight of at least one charge transporting aromatic amine compound, and about 75 percent to about 25 percent by weight of a polymeric film forming resin in which the aromatic amine is soluble.

In embodiments, low molecular weight charge transport substances may include, but are not limited to, pyrenes, carbazoles, hydrazones, oxazoles, oxadiazoles, pyrazolines, arylamines, arylmethanes, benzidines, thiazoles, stilbenes, and butadiene compounds. Further, high molecular weight charge transport substances may include, but are not limited to, poly-N-vinylcarbazoles, poly-N-vinylcarbazole halides, polyvinyl pyrenes, polyvinylanthracenes, polyvinylacridines, pyrene-formaldehyde resins, ethylcarbazole-formaldehyde resins, triphenylmethane polymers, and polysilanes.

In embodiments, the charge transfer layer 15 may contain an additive such as a plasticizer, a surface modifier, an antioxidant or an agent for preventing deterioration by light.

In embodiments, the charge transfer layer 15 may be mixed and applied to a coated or uncoated substrate by various methods, including, but not limited to, spraying, dip coating, roll coating, wire wound rod coating, and the like. In embodiments, the charge transport layer 15 may be dried by various drying method, including, but not limited to, oven drying, infra-red radiation drying, air drying and the like.

In embodiments, an overcoat layer may be applied to improve resistance to abrasion. The overcoat layer may contain a resin, a silicon compound and metal oxide nanoparticles. The overcoat layer may further contain a lubricant or fine particles of a silicone oil or a fluorine material, which can also improve lubricity and strength. In embodiments, the thickness of the overcoat layer is from about 0.1 μm to about 10 μm, from about 0.5 μm to about 7 μm, or from about 1.5 μm to about 3.5 μm.

In embodiments, an anti-curl back coating may be applied to provide flatness and/or abrasion resistance where a web configuration photoreceptor is fabricated. An example of an anti-curl backing layer is described in U.S. Pat. No. 4,654,284, incorporated herein by reference in its entirety.

Image Forming Apparatus and Process Cartridge

In embodiments, an image forming apparatus contains a non-contact charging unit (e.g., a corotron charger) or a contact charging unit, an exposure unit, a developing unit, a transfer unit and a cleaning unit are arranged along the rotational direction of an electrophotographic imaging member. In embodiments, the image forming apparatus is equipped with an image fixing device, and a medium to which a toner image is to be transferred is conveyed to the image fixing device through the transfer device.

In embodiments, the contact charging unit has a roller-shaped contact charging member. The contact charging unit is arranged so that it comes into contact with a surface of the electrophotographic imaging member, and a voltage is applied, thereby being able to give a specified potential to the surface of the electrophotographic imaging member. As a material for such a contact charging member, there can be used a metal such as aluminum, iron or copper, a conductive polymer material such as a polyacetylene, a polypyrrole or a polythiophene, or a dispersion of fine particles of carbon black, copper iodide, silver iodide, zinc sulfide, silicon carbide, a metal oxide or the like in an elastomer material such as polyurethane rubber, silicone rubber, epichlorohydrin rubber, ethylene-propylene rubber, acrylic rubber, fluororubber, styrene-butadiene rubber or butadiene rubber. Examples of the metal oxides include ZnO, $SnO_2$, $TiO_2$, $In_2O_3$, $MoO_3$ and a complex oxide thereof. Further, a perchlorate may be added to the elastomer material to impart conductivity.

In embodiments, a covering layer can also be provided on a surface of the contact charging unit. Materials for forming this covering layer may include N alkoxymethylated nylon, a cellulose resin, a vinylpyridine resin, a phenol resin, a polyurethane, polyvinyl butyral and melamine, and these may be used either alone or as a combination of two or more of them. Furthermore, an emulsion resin material such as an acrylic resin emulsion, a polyester resin emulsion or a polyurethane, particularly an emulsion resin synthesized by soap-free emulsion polymerization can also be used. In order to further adjust resistivity, conductive agent particles may be dispersed in these resins, and in order to prevent deterioration, an antioxidant can also be added thereto. Further, in order to improve film forming properties in forming the covering layer, a leveling agent or a surfactant can also be added to the emulsion resin.

In embodiments, the resistance of the contact charging unit is from $10^0$ to $10^{14}$ Ωcm, or from $10^2$ to $10^{12}$ Ωcm. When a voltage is applied to this contact charging unit, either a DC voltage or an AC voltage can be used as the applied voltage. Further, a superimposed voltage of a DC voltage and an AC voltage can also be used. Such a contact charging unit may be in the shape of a blade, a belt, a brush or the like.

In embodiments, the exposure unit can be an optical device which can perform desired image wise exposure to a surface of the electrophotographic imaging member with a light source such as a semiconductor laser, an LED (light emitting diode) or a liquid crystal shutter. In various embodiments, the use of the exposure unit makes it possible to perform exposure to noninterference light.

In embodiments, the developing unit can be a known or later used developing unit using a normal or reversal developing agent of a one-component system, a two-component system or the like. There is no particular limitation on the shape of a toner used, and for example, an irregularly shaped toner obtained by pulverization or a spherical toner obtained chemical polymerization is suitably used.

In embodiments, the transfer unit can be a contact type transfer charging device using a belt, a roller, a film, a rubber blade or the like, or a scorotron transfer charger or a corotron transfer charger utilizing corona discharge.

In embodiments, the cleaning unit can be a device for removing a remaining toner adhered to the surface of the electrophotographic imaging member after a transfer step, and the cleaned electrophotographic imaging member is repeatedly subjected to the above-mentioned image formation process. The cleaning unit can be a cleaning blade, a cleaning brush, a cleaning roll or the like. In embodiments, a cleaning blade is used. Materials for the cleaning blade may include urethane rubber, neoprene rubber and silicone rubber.

In embodiments, an intermediate transfer belt is supported with a driving roll, a backup roll and a tension roll at a specified tension, and rotatable by the rotation of these rolls without the occurrence of deflection. Further, a secondary transfer roll can be arranged so that it is brought into abutting contact with the backup roll through the intermediate transfer belt. The intermediate transfer belt which has passed between the backup roll and the secondary transfer roll can be cleaned up by a cleaning blade, and then repeatedly subjected to the subsequent image formation process.

The disclosure should not be construed as being limited to the above-mentioned embodiments. For example, in embodiments, the image forming apparatus can be equipped with a process cartridge comprising the electrophotographic imaging member(s) and charging device(s). The use of such a process cartridge allows maintenance to be performed more simply and easily.

Furthermore, in embodiments, a toner image formed on the surface of the electrophotographic imaging member can be directly transferred to the medium. In various other embodiments, the image forming apparatus may be provided with an intermediate transfer body. This makes it possible to transfer the toner image from the intermediate transfer body to the medium after the toner image on the surface of the electrophotographic imaging member has been transferred to the intermediate transfer body. In embodiments, the intermediate transfer body can have a structure in which an elastic layer containing a rubber, an elastomer, a resin or the like and at least one covering layer are laminated on a conductive support.

In addition, in embodiments, the disclosed image forming apparatus may be further equipped with a static eliminator such as an erase light irradiation device. This prevents the incorporation of the residual potential of the electrophotographic imaging member into the subsequent cycle, when the electrophotographic imaging member is repeatedly used.

A method that can be used to incorporate a polymer having a high dielectric constant into a formulation to form an undercoat layer may include forming a coating mixture including the polymer and applying the coating mixture on an electrophotographic imaging member. In one embodiment, a coating mixture including vinylidene fluoride polymer was obtained and used to form the undercoat layer. The method may further include forming at least one imaging layer on the undercoat layer, wherein the at least one imaging layer includes a charge generating layer and a charge transfer layer. Other methods may further include forming an interface layer between the undercoat layer and the charge generating layer, wherein the interface layer includes the polymer having a high dielectric constant, such as vinylidene fluoride polymer.

The undercoat and interface layer may be applied or coated onto a substrate by any suitable technique known in the art, such as spraying, dip coating, draw bar coating, gravure coating, silk screening, air knife coating, reverse roll coating, vacuum deposition, chemical treatment and the like. Additional vacuuming, heating, drying and the like, may be used to remove any solvent remaining after the application or coating to form the undercoat layer and/or the interface layer.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

EXAMPLES

The examples set forth herein below and are illustrative of different compositions and conditions that can be used herein. All proportions are by weight unless otherwise indicated.

Undercoat Layer Having Vinylidene Fluoride Polymer

In Comparative Example 1, the 3-component undercoat layer was prepared as following: zirconium acetylacetonate tributoxide (about 35.5 parts), γ-aminopropyltriethoxysilane (about 4.8 parts) and poly(vinyl butyral) (about 2.5 parts) were dissolved in n-butanol (about 52.2 parts) to prepare a coating solution. The coating solution was coated via a ring coater, and the layer was pre-heated at about 59° C. for about 13 minutes, humidified at about 58° C. (dew point of 54° C.) for about 17 minutes, and then dried at about 135° C. for about 8 minutes. The thickness of the undercoat layer on each photoreceptor was approximately 1.3 μm. The HOGaPc photogeneration layer dispersion were prepared as following: 2.5 grams of HOGaPc Type V pigment was mixed with about 1.67 grams of poly(vinyl chloride/vinyl acetate) copolymer (VMCH from Dow Chemical) and 30 grams of n-butyl acetate. The mixture was milled in an Attritor mill with about 130 grams of 1 mm Hi-Bea borosilicate glass beads for about 1.5 hours. The dispersion was filtered through a 20-μm nylon cloth filter, and the solid content of the dispersion was diluted to about 5 weight percent with n-butyl acetate. The HOGaPc photogeneration layer dispersion was applied on top of the 3-component undercoat layer. The thickness of the photogeneration layer was approximately 0.2 μm. Subsequently, a 28 μm charge transfer layer was coated on top of the photogeneration layer from a dispersion prepared from N,N'-diphenyl-N,N-bis (3-methylphenyl)-1,1'-biphenyl-4,4'-diamine (5.38 grams), a film forming polymer binder PCZ 400 [poly (4,4'-dihydroxy-diphenyl-1-1-cyclohexane, Mw=40,000)] available from Mitsubishi Gas Chemical Company, Ltd. (7.13 grams), and PTFE POLYFLON L-2 microparticle (1 gram) available from Daikin Industries dissolved/dispersed in a solvent mixture of 20 grams of tetrahydrofuran (THF) and 6.7 grams of toluene via CAVIPRO 300 nanomizer (Five Star technology, Cleveland, Ohio). The charge transfer layer was dried at about 120° C. for about 40 minutes.

A polyvinylidene fluoride (PVDF) resin, KYNAR 760 (available from ATOFINA Chemicals, Inc., Philadelphia, Pa., USA), is used for incorporating into an undercoat layer. The coating solution for the undercoat layer was obtained by simply dissolving KYNAR 760 in N,N-dimethyl acetamide (DMAc) with a solid content of about 2 percent by weight. The coating was applied via a Tsukiage coater directly onto an aluminum substrate and subsequently dried at 160° C. for 15 minutes. A transparent coating was obtained.

A couple of devices were prepared with the above polyvinylidene fluoride undercoat layers. In Example 1, the undercoat layer was coated at a thickness of 0.2 μm. In Example 2, the undercoat layer was prepared at a thickness of 0.5 μm. In each of Examples 1 and 2, a photoreceptor was formed in the same manner as for Comparative Example 1 by replacing the 3-component UCL with the polyvinylidene fluoride UCL. The above prepared photoreceptor devices were tested in a scanner set to obtain photo induced discharge cycles, sequenced at one charge-erase cycle followed by one charge-expose-erase cycle, wherein the light intensity was incrementally increased with cycling to produce a series of photo induced discharge characteristic curves (PIDC) from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters; the exposure light source was a 780-nanometer light emitting diode. The aluminum drum was rotated at a speed of about 55 revolutions per minute to produce a surface speed of about 277 millimeters per second or a cycle time of about 1.09 seconds. The xerographic simulation was completed in an environmentally controlled light tight chamber at ambient conditions (about 40 percent relative humidity and about 22° C.).

Figure 2:
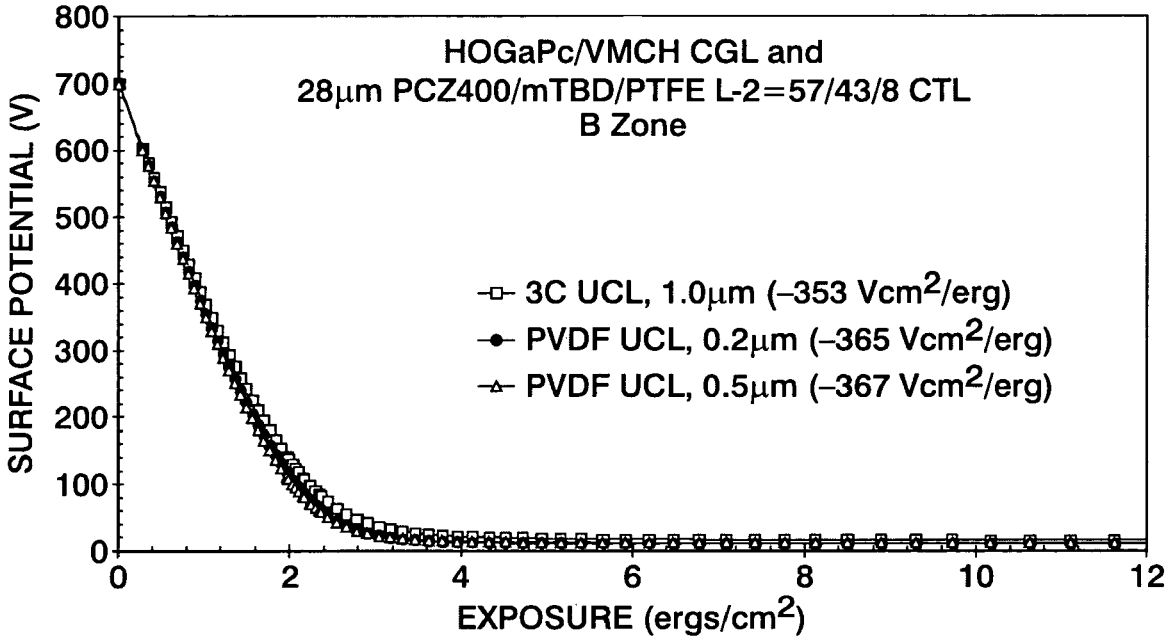
FIG. 2 is a graph illustrating a comparison of the electric properties of various photoreceptors with undercoat layers that do or do not contain vinylidene fluoride polymeric resin.

As illustrated in FIG. 2, the initial slopes of the PIDC curves (sensitivity) for the photoreceptors of Examples 1 (PVDF UCL, 0.2 μm) and 2 (PVDF UCL, 0.5 μm) did not significantly vary from the slope of the PIDC curve of the photoreceptor of Comparative Example 1 (3C UCL, 1.0 μm).

Accordingly, the sensitivities of the photoreceptors of Examples 1 and 2 are not adversely affected by the presence of vinylidene fluoride polymers.

As illustrated in FIG. 2, the charge electric properties and the erase electric properties of the photoreceptors of Examples 1 and 2 did not significantly vary from the charge electric properties and the erase electric properties of the photoreceptor of Comparative Example 1. Accordingly, the electric properties of the photoreceptors of Examples 1 and 2 are not adversely affected by the presence of vinylidene fluoride polymers. The undercoat layers with vinylidene fluoride polymers perform very similarly as the controlled 3-component undercoat layer.

Interface Layer Having Vinylidene Fluoride Polymer

In Comparative Example 2, a TiSi undercoat layer dispersion was prepared by ball milling 15 grams of titanium dioxide (STR60N™, Sakai Company), 20 grams of the phenolic resin (VARCUM™ 29159, OxyChem Company, Mw of about 3,600, viscosity of about 200 cps) in 7.5 grams of 1-butanol and 7.5 grams of xylene with 120 grams of 1 millimeter diameter sized $ZrO_2$ beads for 5 days. Separately, a slurry of $SiO_2$ and a phenolic resin were prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometers pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/Varcum™ dispersion. Additional solvents of 5 grams of 1-butanol, and 5 grams of xylene; 5.4 grams of the above prepared $SiO_2$/Varcum™ slurry were added to 50 grams of the above resulting titanium dioxide/Varcum™ dispersion, referred to as the coating dispersion. Then an aluminum drum, cleaned with detergent and rinsed with deionized water, was dip coated with the above generated coating dispersion at a pull rate of 160 millimeters/minute, and subsequently, dried at 145° C. for 45 minutes, which resulted in an undercoat layer (TiSi UCL) deposited on the aluminum and comprised of $TiO_2$/$SiO_2$/Varcum™ with a weight ratio of about 60/10/40 and a thickness of 4 microns. The HOGaPc photogeneration layer dispersion were prepared as following: 2.5 grams of HOGaPc Type V pigment was mixed with about 1.67 grams of poly (vinyl chloride/vinyl acetate) copolymer (VMCH from Dow Chemical) and 30 grams of n-butyl acetate. The mixture was milled in an Attritor mill with about 130 grams of 1 mm Hi-Bea borosilicate glass beads for about 1.5 hours. The dispersion was filtered through a 20-μm nylon cloth filter, and the solid content of the dispersion was diluted to about 5 weight percent with n-butyl acetate. The HOGaPc photogeneration layer dispersion was applied on top of the TiSi undercoat layer. The thickness of the photogeneration layer was approximately 0.2 μm. Subsequently, a 29 μm charge transfer layer was coated on top of the photogeneration layer from a solution prepared from N,N'-diphenyl-N,N-bis(3-methylphenyl)-1,1'-biphenyl-4,4'-diamine (4 grams), and a film forming polymer binder PCZ 400 [poly(4,4'-dihydroxydiphenyl-1-1-cyclohexane, Mw=40,000)] available from Mitsubishi Gas Chemical Company, Ltd. (6 grams) dissolved in a solvent mixture of 20 grams of tetrahydrofuran (THF) and 6.7 grams of toluene. The charge transfer layer was dried at about 120° C. for about 40 minutes.

A polyvinylidene fluoride resin, KYNAR 760, is used for incorporating into an interface layer, between a charge generating layer and an undercoat layer. The coating solution for the interface layer was obtained by simply dissolving KYNAR 760 in N,N-dimethyl acetamide (DMAC) with a solid content of about 2 percent by weight. The coating was applied via a Tsukiage coater between a TiSi undercoat layer and a HOGaPc/VMCH charge generating layer, and subsequently dried at 160° C. for 15 minutes. A transparent coating was obtained.

A couple of devices were prepared with the above polyvinylidene fluoride interface layers. In Example 3, the interface layer was coated at a thickness of 0.2 μm. In Example 4, the interface layer was prepared at a thickness of 0.5 μm. In each of Examples 3 and 4, a photoreceptor was formed in the same manner as for Comparative Example 2 by adding the polyvinylidene fluoride interface layer between the TiSi undercoat layer and the HOGaPc/VMCH charge generating layer. The above prepared photoreceptor devices were tested in a scanner set to obtain photo induced discharge cycles, sequenced at one charge-erase cycle followed by one charge-expose-erase cycle, wherein the light intensity was incrementally increased with cycling to produce a series of photo induced discharge characteristic curves (PIDC) from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters; the exposure light source was a 780-nanometer light emitting diode. The aluminum drum was rotated at a speed of about 55 revolutions per minute to produce a surface speed of about 277 millimeters per second or a cycle time of about 1.09 seconds. The xerographic simulation was completed in an environmentally controlled light tight chamber at ambient conditions (about 40 percent relative humidity and about 22° C.).

Figure 3:
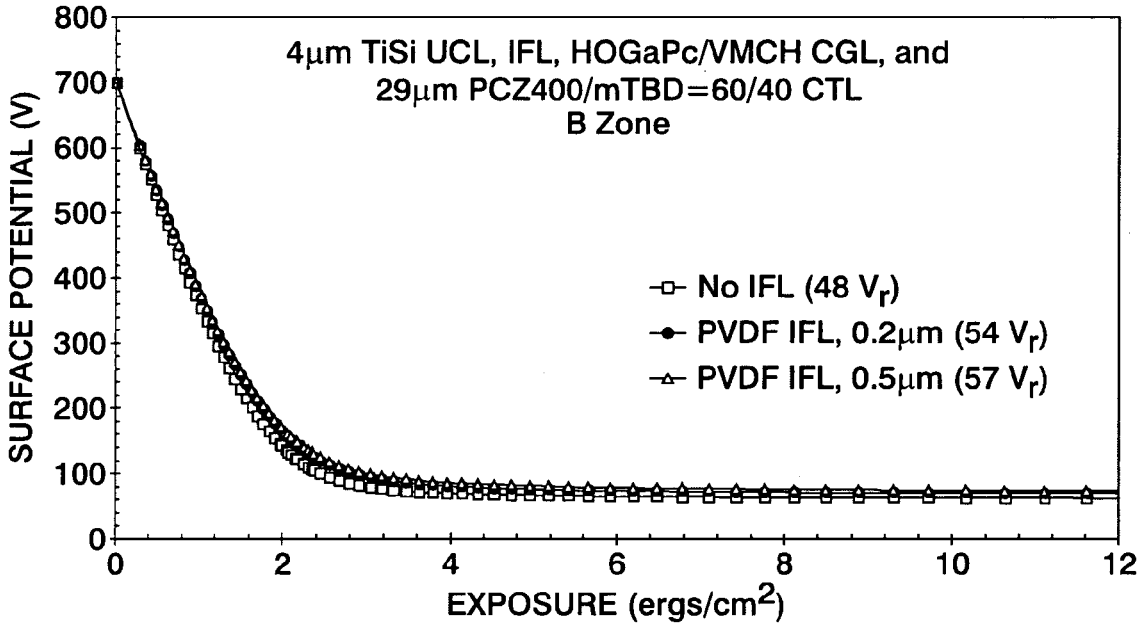
FIG. 3 is a graph illustrating a comparison of the electric properties of various photoreceptors with or without an interface layer that contains vinylidene fluoride polymeric resin.

As illustrated in FIG. 3, the initial slopes of the PIDC curves for the photoreceptors of Example 3 (PVDF IFL, 0.2 μm) and Example 4 (PVDF IFL, 0.5 μm) did not significantly vary from the slope of the PIDC curve of the photoreceptor of Comparative Example 2 (No IFL). Accordingly, the sensitivities of the photoreceptors of Example 3 and Example 4 are not adversely affected by the presence of vinylidene fluoride polymers.

As illustrated in FIG. 3, the charge electric properties and the erase electric properties of the photoreceptors of Example 3 and Example 4 did not significantly vary from the charge electric properties and the erase electric properties of the photoreceptor of Comparative Example 2. Accordingly, the electric properties of the photoreceptors of Example 3 and Example 4 are not adversely affected by the presence of vinylidene fluoride polymers.

The photoreceptors incorporating vinylidene fluoride resins as undercoat layers with thin charge transfer layers (e.g., 15 μm) have demonstrated comparable A zone (80% humidity and 27° C.) background in comparison to those with three-component undercoat layers.

The photoreceptors incorporating vinylidene fluoride resins as interface layers with thin charge transfer layers (e.g., 15 μm) have demonstrated significantly lower A zone (80% humidity and 27° C.) background as compared with photoreceptors without any interface layers included.

While the description above refers to particular embodiments herein, it will be understood that many modifications may be made without departing from the spirit thereof. The accompanying claims are intended to cover such modifications as would fall within the true scope and spirit herein.

What is claimed is:

1. An electrophotographic imaging member, comprising:

a substrate;

an undercoat layer formed on the substrate;

at least one imaging layer formed on the undercoat layer; and optionally an interface layer formed between the undercoat layer and the at least one imaging layer, wherein at least one of the undercoat layer and the interface layer comprises a polymer having a high dielectric constant of about 5 or greater at 20° C. and 1 kHz and the polymer comprises vinylidene fluoride.

2. The electrophotographic imaging member of claim 1, wherein the polymer has a dielectric constant of about 10 or greater at 20° C. and 1 kHz.

3. The electrophotographic imaging member of claim 1, wherein the polymer comprising vinylidene fluoride is synthesized from polymerization of two or more vinylidene fluoride monomers.

4. The electrophotographic imaging member of claim 1, wherein the polymer comprising vinylidene fluoride is synthesized from copolytnerization of a vinylidene fluoride monomer and at least one other fluorine-containing monomer.

5. The electrophotographic imaging member of claim 4, wherein the at least one other fluorine-containing monomer is selected from the group consisting of tetrafluoroethylene, trifluoroethylene, trifluorochloroethylene, trifluorobromoethylene, hexafluoropropylene, difluorochloroethylene, difluorobromoethylene, fluorochloroethylene, and the like, and mixtures thereof.

6. The electrophotographic imaging member of claim 1, wherein the polymer comprising vinylidene fluoride is selected from the group consisting of

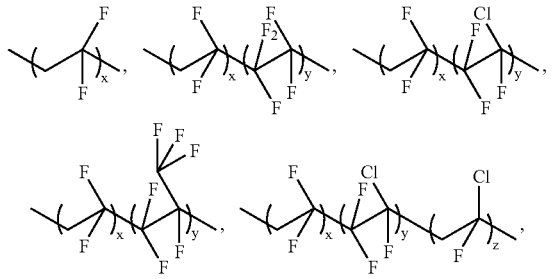

and mixtures thereof, wherein x is from about 10 to about 100 mole percent, y is from about 0 to about 90 mole percent, z if from about 0 to about 90 mole percent, and x+y+z=100.

7. The electrophotographic imaging member of claim 1, wherein the at least one imaging layer includes a charge generation layer and a charge transport layer.

8. The electrophotographic imaging member of claim 1, wherein the undercoat layer has a thickness from about 0.001 μm to about 30 μm, or from about 0.01 μm to about 5 μm, or from about 0.1 μm to about 1 μm, and the interface layer has a thickness from about 0.001 μm to about 5 μm, or from about 0.01 μm to about 1 μm, or from about 0.1 μm to about 0.5 μm.

9. The electrophotographic imaging member of claim 1, wherein the undercoat layer comprises the polymer having a high dielectric constant, wherein the polymer consists of vinylidene fluoride.

10. The electrophotographic imaging member of claim 1, comprising an interface layer comprising the polymer having a high dielectric constant, wherein the polymer consists of vinylidene fluoride.

11. The electrophotographic imaging member of claim 1, comprising an interface layer comprising the polymer having a high dielectric constant, wherein the interface layer and the undercoat layer each comprises the polymer.

12. A process cartridge comprising the electrophotographic imaging member of claim 1 and at least one of a developing unit and a cleaning unit.

13. An image forming apparatus comprising at least one charging unit, at least one exposing unit, at least one developing unit, a transfer unit, a cleaning unit, and the electrophotographic imaging member of claim 1.

14. A process for preparing an electrophotographic imaging member, comprising:

forming an undercoat layer on an electrophotographic imaging member;

forming at least one imaging layer on the undercoat layer; and optionally forming an interface layer formed between the undercoat layer and the at least one imaging layer, wherein at least one of the undercoat layer and the interface layer comprises a polymer having a high dielectric constant of about 5 or greater at 20° C. and 1 kHz and the polymer comprises vinylidene fluoride.

15. The process of claim 14, wherein the polymer has a dielectric constant of about 10 or greater at 20° C. and 1 kHz.

16. The process of claim 14, wherein the undercoat layer has a thickness from about 0.001 μm to about 30 μm, or from about 0.01 μm to about 5 μm, or from about 0.1 μm to about 1 μm, and the interface layer has a thickness from about 0.00 1 μm to about 5 μm, or from about 0.01 μm to about 1 μm, or from about 0.1 μm to about 0.5 μm.

17. The process of claim 14 further including forming an interface layer comprising the polymer having a high dielectric constant, wherein the interface layer and the undercoat layer each comprises the polymer.

* * * * *